United States Patent [19]

Hyde

[11] 4,394,090

[45] Jul. 19, 1983

[54] PROCESS TIMING APPARATUS

[75] Inventor: Robert L. Hyde, Bartlesville, Okla.

[73] Assignee: TRW Inc., Cleveland, Ohio

[21] Appl. No.: 251,045

[22] Filed: Apr. 6, 1981

[51] Int. Cl.[3] ..... G04F 8/00; G04F 10/00

[52] U.S. Cl. ..... 368/121; 368/9; 368/1

[58] Field of Search ..... 368/1, 3, 4, 9, 11, 368/12, 121; 340/52 R, 52 F; 364/569, 144, 145

[56] References Cited

U.S. PATENT DOCUMENTS

| | | | |
|---|---|---|---|
| 3,543,108 | 11/1970 | Collins et al. | 368/121 |
| 3,588,699 | 6/1971 | Pysnik | 368/121 |
| 4,136,329 | 1/1979 | Trobert | 340/52 F |
| 4,140,996 | 2/1979 | Leitch et al. | 340/52 F |
| 4,317,106 | 2/1982 | Huber | 368/11 |

OTHER PUBLICATIONS

Electronic Design, vol. 25, pp. 108, 110, "Time Interval Meter Reads Digitally to 99.9 MS on a DVM 1c", 3/77.

*Primary Examiner*—Bernard Roskoski

*Attorney, Agent, or Firm*—Shapiro and Shapiro

[57] ABSTRACT

An indicating electronic timer useful for timing processing events and for controlling a process measures the elapsed time from a moment at which a process variable attains a predetermined value and produces a signal which varies in accordance with the elapsed time. During a timing operation, the signal is displayed on a display device which normally displays the process variable, and may be such that the display device indicates the percentage of a predetermined time interval which has elapsed. The timer may be conveniently implemented with relatively inexpensive integrated circuits, such as a variable oscillator, binary counters, and D/A converters.

24 Claims, 2 Drawing Figures

PROCESS TIMING APPARATUS

BACKGROUND OF THE INVENTION

The present invention relates to electronic timers useful for timing and controlling processing operations in a processing system and for indicating timing information to an operator.

In many processes it is desirable or necessary to vary or to terminate the process for a period of time upon the occurrence of a certain event. For example, when a submergible motor-driven pump is employed in a downhole petroleum reservoir in an oil well for pumping liquid to the surface, if the liquid is pumped from the reservoir faster than the rate at which it enters, eventually the liquid level will decrease below the level of the pump intake. When this occurs, it is desirable to shut down the pump until the liquid is restored to a level sufficient for pumping. This may require several minutes or several hours depending upon various factors. Since oil well pumping systems normally monitor one or more process variables associated with the motor/-pump, such as flow or motor current, a drop in liquid level below the pump intake may be readily detected and the pump may be shut down automatically. After a predetermined period of time has elapsed which is sufficient for the reservoir to refill, the pump may be restarted. A timer is normally used for measuring the pump down-time. The timer may be associated with a control system or it may be used simply for signaling an operator to restart the pump manually. Preferably, the timer is variable so that the amount of time that the pump is shut down can be varied as desired, and, preferably, it is capable of indicating timing information to the operator so that he knows how long he must wait for the pump to be restarted.

Timers are known which may be employed for these purposes. However, known timers have several disadvantages. Mechanical timers tend to be cumbersome and must be manually reset after each timing operation. Their accuracy may vary significantly with temperature and other environmental factors, and they are difficult to seal to prevent corrosion, etc., which may affect their operation.

Electro-mechanical timers which employ a small electrical timing motor for advancing a pointer through gears until a predetermined time has elapsed may also be used. Resetting of the timers is usually automatic, and they are generally more accurate than mechanical timers. However, they also tend to be large and present sealing difficulties which are similar to those in mechanical timers. Moreover, since the timing motor is usually wound with a large number of turns of very fine wire, it is susceptible to insulation failure when used on power lines which are subjected to lightning induced surges.

Available electronic timers avoid some of the above problems but tend to be complicated and expensive devices. Also, they normally must be purchased as a stand-alone device.

It is desirable to provide indicating electronic timers which overcome these and other disadvantages of prior art timers, and it is to this end that the present invention is directed.

SUMMARY OF THE INVENTION

Among the important advantages provided by the indicating electronic timers of the invention are that they may be constructed from a small number of readily available and inexpensive electronic components; they may be readily incorporated into an electrical process control device, and may "piggyback" on the control device by utilizing certain of its electrical components for their operation. They have good accuracy, are easily variable over a fairly wide timing range, and indicate timing information in a novel and very convenient manner. If desired, they may be used for automatically timing and controlling processing events, in addition to displaying timing information to an operator.

Briefly stated, in accordance with one aspect of the invention, an indicating electronic timer for a process may comprise a display device normally operative to display a value representative of a process variable, means for measuring an elapsed time from a moment at which the process variable attains a predetermined value, means responsive to the measuring means for producing a signal which varies in accordance with the elapsed time, and means for displaying a value representative of the signal on the display device in place of the value representative of the process variable.

DESCRIPTION OF THE PREFERRED EMBODIMENT

The present invention is particularly adapted for timing and controlling operations in a processing system, and will be described in that environment. As will become apparent, however, this is merely illustrative of one utility of the invention.

Figure 1:
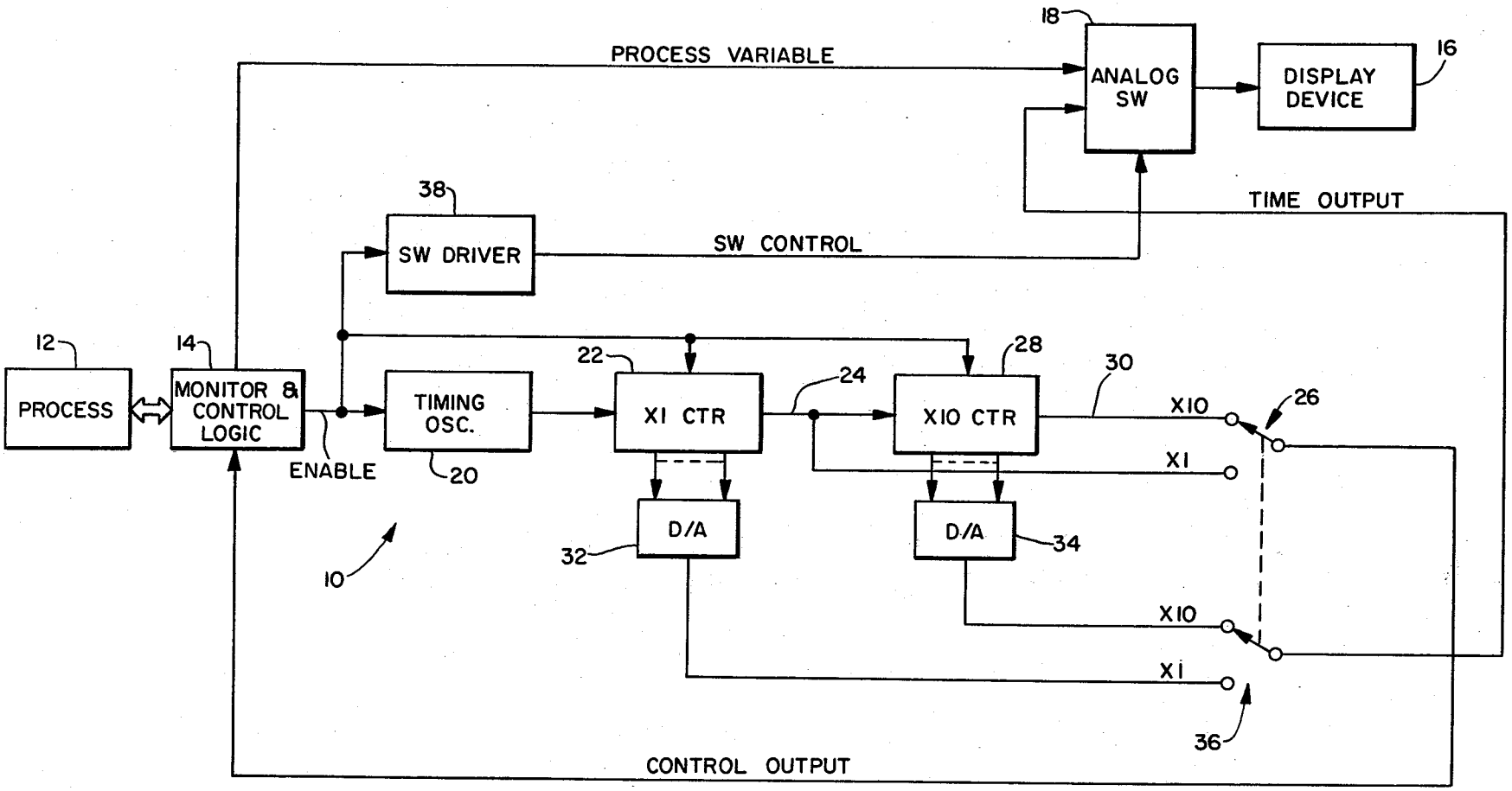
FIG. 1 is a functional block diagram illustrating an indicating electronic timer in accordance with the invention employed with a processing system.

In FIG. 1 an indicating electronic timer 10 in accordance with the invention is shown employed with a processing system comprising a process 12 and associated monitor and control logic 14 which monitors one or more processing variables and apropriately controls the process. The particular nature of process 12 is relatively unimportant as long as it has at least two processing states, which may correspond to "on" or "off," for example, and it is required to switch from one processing state to the other for a period of time upon the occurrence of some event, such as a particular process variable attaining a predetermined value.

For purposes of explaining the invention, it may be assumed, for example, that process 12 is an oil well pumping process such as previously described in which it is desirable to shut down a downhole submergible motor-driven pump for a predetermined period of time when the liquid level in a downhole reservoir drops below the level of the pump intake. In this case, the monitor and control logic 14 may include means for monitoring the motor current (or another process variable associated with the liquid level in the reservoir) and means for controlling contactors in a power line which supplies power to the downhole motor to interrupt the power when the motor current drops to its no-load value. The monitor and control logic 14 may also supply a value representative of the process variable (motor current) to a display device 16 through an analog switch 18, the purpose of which will be described later, to permit the process variable to be monitored by an operator. The display device may, for example, be either an analog or a digital meter calibrated to read and to display the value of motor current, and may be located on a front panel of a control unit (not illustrated) which houses the monitor and control logic.

As shown in FIG. 1, the indicating electronic timer 10 may comprise a timing oscillator 20 for producing a predetermined frequency and a counter 22 connected to the output of the timing oscillator for counting the number of output cycles of the predetermined frequency. The timing oscillator may be disabled normally and may be enabled to initiate a timing operation by an enable signal produced by the monitor and control logic 14, as indicated, upon a particular process variable attaining a predetermined value, e.g., upon the motor current decreasing to its no-load value. Upon the oscillator being enabled, the predetermined frequency produced by the oscillator increments the counter from a preset state to a successive state so that at any given time during a timing operation, the state of the counter, i.e., its count, is representative of the elapsed time from the initiation of the timing operation. The counter may be arranged such that when the counter reaches a predetermined count, for example, its maximum count, the counter resets itself and issues an output signal on an output line 24 which is coupled through a switch 26 back to the monitor and control logic. This output signal may cause the monitor and control logic to disable the timing oscillator 20, terminating the timing operation, and may also cause the monitor and control logic to vary the state of the process, e.g., to restart the pump motor. Accordingly, by appropriately selecting the predetermined frequency generated by the timing oscillator and the number of stages of counter 22, a predetermined period of time may be measured and the processing state may be appropriately controlled.

As is also shown in FIG. 1, a second counter 28 may be connected to output 24 of counter 22 so that each time counter 22 completes a counting cycle, i.e., reaches a predetermined count, counter 28 increments by one count. Counter 28 may be arranged such that when it reaches another predetermined count, an output signal is provided on an output line 30 to switch 26. Switch 26 enables the output signal on either line 24 (of counter 22) or line 30 (of counter 28) to be fed back to the monitor and control logic.

Counter 28 serves to multiply the predetermined time period measured by timing oscillator 20 and counter 22 (which will be referred to herein as the "primary timing interval") by a factor equal to the predetermined count at which it outputs a signal on output line 30. Accordingly, the primary timing interval is extended by the same factor. It is convenient to select this factor to be equal to 10 so that if, for example, the primary timing interval is one minute, by selecting the output signal on output 30 of counter 28 with switch 26 as the signal fed back to the monitor and control logic, the primary timing interval can be extended to ten minutes. (The extended primary timing interval will be referred to herein as the "extended timing interval.") As will be explained shortly, timing oscillator 20 is preferably a variable oscillator which is capable of varying its output frequency over a selected range. Accordingly, timing oscillator 20 and counter 22 may be used for measuring a first predetermined range of times (primary timing mode), which may be multiplied by a factor of 10 using counter 28 (extended timing mode). This conveniently enables the indicating electronic timer to be used for timing different events or for varying the timing of a particular event.

As previously discussed, in processes such as an oil well pumping process in which a submergible motor/-pump is shut down for a predetermined period of time to enable an underground reservoir to refill, it is desirable to give an operator an indication of the elapsed time that the pump has been shut down so that he knows how long he must wait for the process to be restarted, or if it is to be restarted manually, when to do so. This is accomplished by the invention in a manner which will now be explained.

As shown in FIG. 1, a digital-to-analog converter (D/A) 32, 34 may be connected to each counter 22, 28. Preferably, each D/A converter is responsive to the state, i.e., count, of its associated counter and includes means for producing a signal which varies as a function of that count. In accordance with a preferred construction of the timer, which will be described in detail shortly, the signal produced by each D/A converter may be either directly or inversely proportional to the count, and is preferably in a form which can be displayed directly on display device 16. Accordingly, the signal produced by D/A converter 32 is proportional to the portion of the primary timing interval which has elapsed since the initiation of a timing operation. Similarly, the signal produced by D/A converter 34 is proportional to the portion of the extended timing interval which has elapsed since the initiation of the timing operation. If the signals are directly proportional to the portions of their respective timing intervals which have elapsed, they represent the percentage of the timing interval which has elapsed. Conversely, if the signals are inversely proportional to the portions which have elapsed, they represent the percentage of the timing interval which has not elapsed.

The signals produced by D/A converters 32 and 34 are furnished to analog switch 18 through a switch 36 which alternately selects the signal from converter 32 or converter 34. As shown in FIG. 1, switches 26 and 36 may be ganged together so that the appropriate D/A converter output signal is selected depending upon whether the timer is being operated in the primary (X1) or the extended (X10) mode.

Analog switch 18 serves to connect either the process variable or the timer output (D/A converter output) to display device 16. The position of the analog switch may be controlled by a switch driver 38 which responds to the enable signal generated by the monitor and control logic for initiating a timing operation and outputs appropriate control signals to the analog switch. During normal operation, the process variable would be connected to the display device. However, when the process variable attains a predetermined value and the monitor and control logic initiates a timing operation, the switch driver controls the analog switch to connect the timer output to the display device for the duration of the timing operation. This permits the timer output to be displayed in place of the process variable to provide timing information to an operator.

As previously indicated, the signals generated by the D/A converters 32 and 34 may be either directly or inversely proportional to the elapsed time periods measured by their respective counters. As will be explained shortly, it is convenient to employ a voltmeter for display device 16 and to construct D/A converters 32 and 34 so that their output signals are voltages that vary in direct proportion to the counts of their associated counters over a range of voltage values which enables timing information to be displayed as a percentage of either the elapsed time from the initiation of a timing operation or the time remaining in the timing interval being measured. For example, if the voltage range is selected such that the magnitude of the voltage produced by each D/A converter varies from 0 to either ±10 volts as its associated counter progresses through one complete counting cycle, the display device can be conveniently made to indicate a number equal to the percentage of elapsed time that has occurred from the initiation of a timing operation. Alternately, if each D/A converter is constructed so that its output varies from either ±10 volts to 0 volts as its associated counter progresses through one complete counting cycle, the display device can be conveniently made to indicate a number equal to the percentage of time remaining in the timing interval being measured.

Displaying time information as a percentage rather than as real time affords several advantages. It significantly reduces the number of components which would otherwise be necessary to display real time, particularly where the timing oscillator is variable to enable a wide range of times to be measured, and enables the same display device used for monitoring the process variable, the value of which is normally most conveniently available in analog form, to be used for displaying time information.

Figure 2:
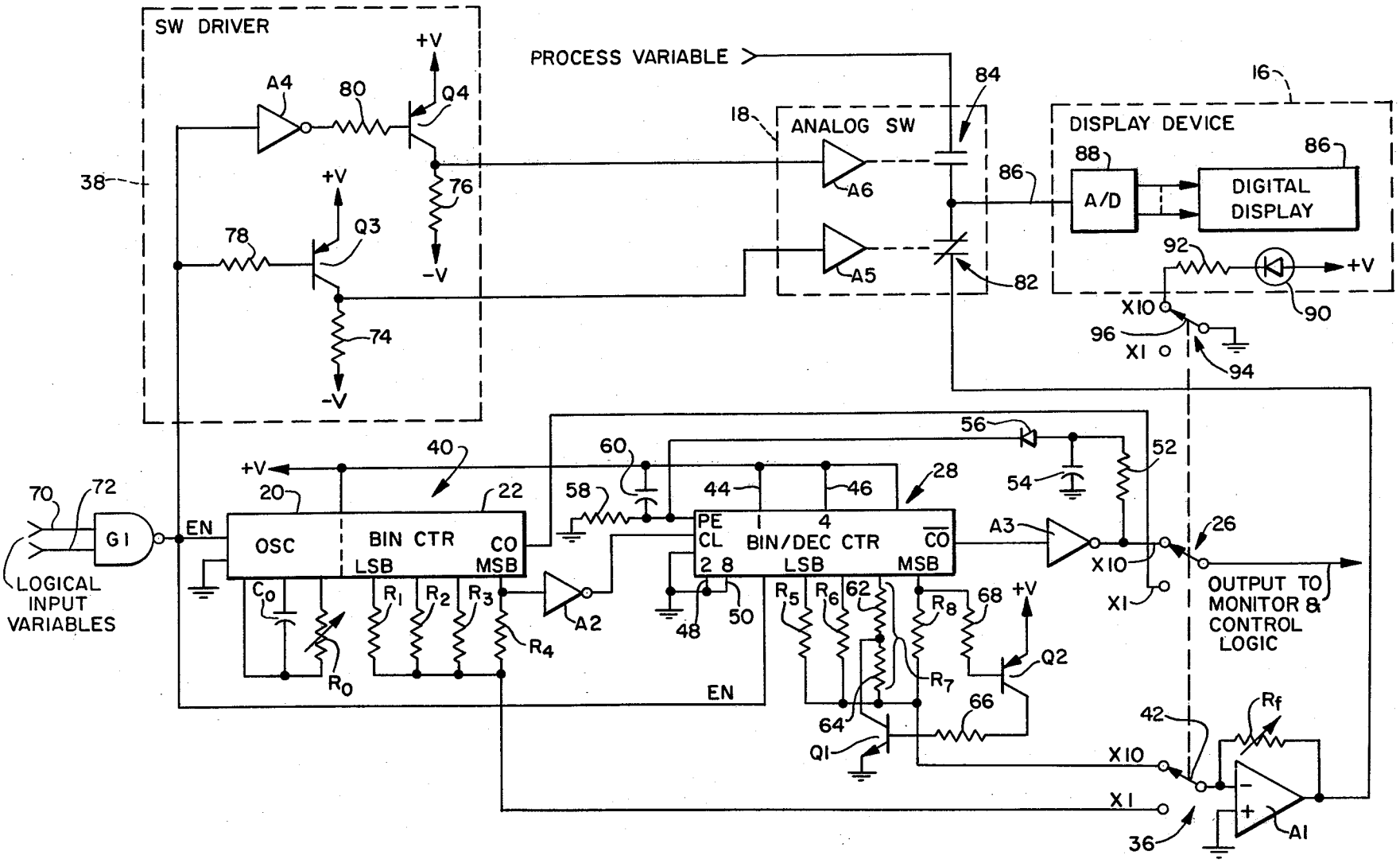
FIG. 2 is a schematic diagram of the indicating electronic timer of FIG. 1.

FIG. 2 is a schematic diagram of the indicating electronic timer 10 of FIG. 1, illustrating preferred construction details, which will now be described.

As illustrated in FIG. 2, timing oscillator 20 and counter 22 may be implemented as a single integrated circuit, which includes a variable oscillator and a binary counter driven by the oscillator output within a single integrated circuit package. An inexpensive, commercially available device which may be used is a Motorola type MC 14521. The oscillator frequency may be set by appropriately selecting the values of a timing capacitor $C_o$ and a timing resistor $R_0$. Preferably, timing resistor $R_0$ is a variable resistor to enable the frequency of the oscillator to be varied over a predetermined frequency range. The counter comprises a four-stage binary counter having 16 states in one complete counting cycle, the four counter stages having outputs representing the decimal values 1, 2, 4, and 8, respectively. As the counter steps through its counting cycle, the stages turn on and off so that their outputs go high (corresponding to a logic 1) and low (corresponding to a logic 0). As is well known, a count is represented by the sum of the decimal values of the stages which are on, i.e., whose outputs are at a logic 1 level. Thus, when all of the outputs are low (binary 0000), a count of decimal 0 is represented. When all of the outputs are high (binary 1111), a count of decimal 15 is represented.

As shown in FIG. 2, the outputs from the four counter stages are connected together through resistors $R_1$–$R_4$ and are supplied to the X1 terminal of switch 36. $R_1$ is connected to the output which represents the least significant bit (LSB), i.e., decimal value 1, and $R_4$ is connected to the output which represents the most significant bit (MSB), i.e., decimal value 8. When the movable contact 42 of switch 36 is moved to the X1 terminal of the switch, resistors $R_1$–$R_4$ are connected in parallel to the inverting input of an operational amplifier A1. The output of the amplifier is fed back to its inverting input through a feedback resistor $R_f$ and is also supplied to one input of analog switch 18, as shown. Resistors $R_1$–$R_4$ and amplifier A1 constitute D/A converter 32, as will now be described.

When resistors $R_1$–$R_4$ are connected to the inverting terminal of amplifier A1, the amplifier serves as a summing amplifier whose output voltage, $V_0$ is given by the following equation:

$$V_0 = -R_f\left(\frac{V_1}{R_1} + \frac{V_2}{R_2} + \frac{V_3}{R_3} + \frac{V_4}{R_4}\right), \quad (1)$$

where $V_1$–$V_4$ are the respective output voltages of the counter stages to which resistors $R_1$–$R_4$ are connected. As the counter steps through its counting cycle counting from 0 to 15, voltages $V_1$–$V_4$ will vary between logic 0 and logic 1 in accordance with the binary counting pattern. For example, assuming logic 0 corresponds to ground, i.e., 0 volts, at a count of 0 (binary 0000), voltages $V_1$–$V_4$ will all be 0 volts and the output of amplifier A1 will also be 0 volts from Equation 1. Assuming, for purposes of explanation, that logic 1 corresponds to 1 volt, when the counter progresses to a count of 1 (binary 0001) $V_1$ (corresponding to the LSB output) will go from 0 to 1 volt. The other voltages will remain at ground. Accordingly, the amplifier output $V_0$ will be $V_0 = -R_f/R_1$. Similarly, when the counter has progressed to a count of 5 (binary 0101), $V_1$ and $V_3$ (corresponding to the decimal values 1 and 4, respectively) will be one volt, and $V_0 = -R_f(1/R_1 + 1/R_3)$.

As the counter progresses through its 16 counting states, the combination of voltages $V_1$–$V_4$ inputted to amplifier A1 will vary in accordance with the binary counting pattern. By selecting the resistance values of $R_1$–$R_4$ in the proportions 8:4:2:1, for example, 80K ohms, 40K ohms, 20K ohms and 10K ohms, respectively, the absolute value of the output voltage of amplifier A1 will progressively increase (in a negative direction from 0 volts) in a staircase fashion of 16 equal-voltage steps as the counter counts from 0 to 15. Each voltage step will represent approximately 6.65 percent of the total voltage swing, and the output voltage of the amplifier will be proportional to the percentage of the total counting cycle which has been completed, i.e., the percentage of the timing interval which has elapsed from the initiation of the timing operation. As is apparent, by increasing the number of counter stages, the total voltage swing can be divided into a greater number of steps, each representing a smaller percentage of the total. By appropriately selecting the values of $R_1$–$R_4$ and $R_f$ in relation to the logic 1 voltage level, the magnitude of the output voltage of the amplifier can be adjusted so that the display device indicates directly the percentage of the timing interval which has elapsed, as previously explained. As shown in FIG. 2, resistor $R_f$ may be made variable for calibration purposes.

If instead of indicating on the display device the percentage of the timing interval which has elapsed, it is desired to indicate the percentage of time remaining in the timing interval, it is simply necessary to complement the counter outputs supplied to $R_1$–$R_4$, as with inverters, or to invert the output of A1. The absolute value of the output voltage of A1 will then decrease as the counter progresses through its counting cycle.

As previously indicated, and as is evident from the foregoing description, oscillator 20 and counter 22 may be used for measuring a predetermined period of time by appropriately selecting the frequency generated by oscillator 20. Binary counter 22 functions as a time multiplier, i.e., a frequency divider, which multiplies the period of the frequency produced by oscillator 20 by a factor of 16. Accordingly, if it is desired to employ oscillator 20 and counter 22 to measure a time interval between 1 and 10 minutes, the values of timing capacitor $C_0$ and timing resistor $R_0$ would be selected such that the frequency of the oscillator could be varied between $2.66\times10^{-1}$ Hz and $2.66\times10^{-1}$ Hz. A calibrated control, such as a knob, for timing resistor $R_0$ may be provided on the front panel of the control unit (not illustrated) to enable the timing interval to be varied as desired.

As previously described, counter 28 may be employed for extending the primary timing interval measured by oscillator 20 and counter 22 by a factor of 10. As shown in FIG. 2, counter 28 may be an integrated circuit four stage binary counter, such as an RCA type CD 4029 AE integrated circuit, connected to operate as a decade counter. This is accomplished by connecting the programming inputs 44 and 46 of the stages representing decimal 1 and 4, respectively, to the supply voltage +V, and by connecting the programming inputs 48 and 50 of the stages representing decimal 2 and 8, respectively, to ground to preset the counter to a count of 5, i.e., binary 0101, so that the counter counts from 5 to 15 and then back to 5.

The MSB output from counter 22 is connected to the clock (CL) input of counter 28 through an inverter amplifier A2. Each time the MSB output of counter 22 goes from a logic 1 level to a logic 0 level, as when counter 22 steps from a count of 15 to a count of 0 at the end of its counting cycle, a positive going signal is applied to the clock input of counter 28 to advance counter 28 one count. When counter 28 reaches a count of 15, the next clock input produces a negative-going carry pulse at the $\overline{CO}$ output of counter 28, which is inverted by an inverter amplifier A3. The inverted carry pulse from amplifier A3 is fed back to the preset enable (PE) input of the counter through a feedback path comprising a resistor 52, a capacitor 54, and a diode 56. The PE input of counter 28 is normally held at ground potential by a resistor 58, and is connected to the supply voltage through a capacitor 60, as shown. When a positive-going signal is applied to the preset enable of counter 28, the counter is reset to its programmed state, i.e., a count of 5. Accordingly, when the negative-going carry pulse at the $\overline{CO}$ output of counter 28 is inverted and fed back to the PE input of the counter, the counter steps from a count of 15 to a count of 5, the preprogrammed state. Accordingly, counter 28 counts from 5 to 15 and then back to 5 again (11 states) in a complete counting cycle. Resistor 52, capacitor 54, resistor 58 and capacitor 60 are for timing and isolation.

The positive going output of inverter amplifier A3 is also supplied to the X10 terminal of switch 26 and is fed back to the monitor and control logic for control purposes, as previously described, when switch 26 is in the X10 position. As shown in FIG. 2, counter 22 has a carry output CO connected to the X1 terminal of switch 26 on which a positive going carry signal is produced when counter 22 steps from a count of 15 to a count of 0. Accordingly, when switch 26 is in the X1 position, the carry signal of counter 22 is fed back to the monitor and control logic for control purposes.

As with counter 22, the outputs of the stages of counter 28 representing the decimal values, 1, 2, 4 and 8 may be connected together through resistors $R_5$, $R_6$, $R_7$, and $R_8$, respectively, to the X10 terminal of switch 36. When switch 36 is in the X10 position, resistors $R_5$–$R_8$ are connected to the inverting terminal of amplifier A1, and the resistors and the amplifier constitute D/A converter 34 which, except as will be described hereinafter, functions in a manner generally similar to the D/A converter described in connection with counter 22 to produce an output voltage which is proportional to the count of counter 28. However, since the counting cycle of counter 28 comprises 11 stages rather than 16, the output voltage of amplifier A1 will be a staircase voltage of 11 equal steps, each representing approximately 9.1% of the total voltage swing. Also, the construction and operation of the resistor network $R_5$–$R_7$ is somewhat different from that of resistor network $R_1$–$R_4$, as will now be explained.

Because counter 28 begins its counting cycle at counter 5 and has 11 discrete steps, i.e., it divides by 11, in order to cause amplifier A1 to produce the desired staircase output voltage which increases in proportion to the count, it is necessary to select the resistance values of resistors $R_5$–$R_8$ in the proportions 4:2:1:1, respectively. For example, $R_5$, the LSB output, may be selected to be 60K ohms, $R_6$ to be 30K ohms, and $R_7$ and $R_8$ each selected to be 15K ohms. Also, $R_7$ comprises two resistors 62 and 64 connected in series, as shown, the sum of their values being selected to equal the required value of $R_7$. The common point between resistors 62 and 64 is connected to the collector of a transistor Q1, the emitter of which is grounded. The base of Q1 is connected through a resistor 66 to the collector of another transistor Q2 which has its base connected to the MSB output of counter 28 through a resistor 68. When the MSB output of counter 28 is at a logic 0 level (which occurs for counts of 5, 6, and 7, i.e., 0101, 0110, and 0111, respectively), transistor Q1 conducts and turns on transistor Q1, causing the counter stage output associated with $R_7$ (decimal value 4) to be grounded through resistor 62. At counts of 5, 6, and 7, the output voltage of this stage is a logic 1 and the voltage corresponding to logic 1 would normally appear at the input of amplifier A1 through resistor $R_7$. However, because of Q1 and Q2, voltages are inputted to the amplifier only from the counter stages associated with resistors $R_5$ and $R_6$. At counts of 8 to 15, the MSB output of counter 8 is at a logic 1 level. This turns off transistors Q2 and Q1 so that the normal binary pattern of output voltages from the counter is inputted to the amplifier. The result of this arrangement is that the absolute value of the output voltage of amplifier A1 progressively increases (in a negative direction) in proportion to the count of counter 28 as the counter progresses through its counting cycle. As before, by appropriately selecting the values of resistors $R_5$–$R_8$ in relation to $R_f$ and to the logic 1 voltage level, the magnitude of the output voltage of A1 can be adjusted so that the display device indicates directly the percentage of the extended timing interval which has elapsed.

Integrated circuit 40 (oscillator 20 and counter 22) and counter 28 require a logic 0 level at their enable (EN) inputs for their operation. As shown in FIG. 2, the enable signal may be derived from the output of NAND gate G1, which may be part of the monitor and control logic 14. G1 may have two inputs, 70 and 72, for receiving logical input variables for controlling the timer. One input, e.g., 70, of the gate may be connected to the portion of the monitor and control logic which monitors the value of the process variable of interest (motor current) and which produces a logic 1 level when the process variable attains a predetermined value. The other input to the gate may be connected to a manualautomatic switch for controlling the operating mode of the timer. When both gate inputs go high (are at a logic 1 level), its output will go low, producing the enable signals required by oscillator 20 and counters 22 and 28, and initiating a timing operation.

The enable signal from gate G1 may also control the switch driver 38, which controls analog switch 18. As shown in FIG. 2, the switch driver may comprise a pair of transistors Q3 and Q4 having their emitters connected to a positive voltage source and having their collectors connected to a negative voltage source through respective current limiting resistors 74 and 76. The output of gate G1 is connected to the base of transistor Q3 through a resistor 78, and is connected to the base of transistor Q4 through an inverter amplifier A4 and a resistor 80. Accordingly, transistors Q3 and Q4 alternately conduct, depending upon the output level of gate G1.

Analog switch 18 is preferably an integrated circuit analog switch, such as a Motorola type MC 14066, which is indicated schematically in FIG. 2 as comprising two sets of contacts 82 and 84 connected to an output 86 which is supplied to the display device, and a pair of amplifiers A5 and A6 for controlling contacts 82 and 84, respectively.

As shown in FIG. 2, the collector of transistor Q3 is connected to the input of amplifier A5, and the collector of transistor Q4 is connected to the input of amplifier A6. When either transistor Q3 or Q4 turns on, a positive voltage is applied to the input of its associated amplifier A5 or A6 causing the corresponding contacts 82 or 84 to be closed. When contacts 82 are closed, the output of the timer is connected to the display device. When contacts 84 are closed, the process variable is connected to the display device.

When the output of gate G1 is at a logic 1 level (during normal operation), transistor Q4 will conduct causing contacts 84 to be closed and the process variable to be connected to the display device. Transistor Q3 will be off and contacts 82 will be open. When the output of gate G1 goes low, to initiate a timing operation, transistor Q3 will turn on and transistor Q4 will turn off, opening contacts 84 and closing contacts 82 to connect the output of the timer to the display device. Transistor Q3 remains conducting as long as the output of G1 is low, which is for the duration of the timing operation.

Display device 16 is preferably a digital voltmeter (although an analog voltmeter may also be used) which is capable of displaying either positive or negative voltages, and may comprise an LED digital display 86 and an associated A/D converter and driver circuit 88, which may be an integrated circuit such as an Intersil type 1CL 7107 CPL. The display device may also comprise an indicator 90, such as an LED connected in series with a resistor 92 to the positive supply voltage and to the X10 terminal of a switch 94. When the movable contact 96 of the switch is in the X10 position, resistor 92 is grounded causing display element 90 to be illuminated to indicate that the timer is in the extended or X10 timing mode. Preferably, switch 94 is ganged to switches 26 and 36, as indicated in FIG. 2.

In operation, analog switch contacts 84 are normally closed to connect the process variable, e.g., motor current, to the display device so that an operator can monitor the value of the process variable. When the process variable attains a predetermined value, e.g., the motor current drops to its no-load value, the output of gate G1 goes low. This turns transistor Q3 on and transistor Q4 off to close contacts 82 and open contacts 84 of the analog switch, connecting the output of the timer to the display device. At the same time, oscillator 20 is enabled to begin producing its predetermined frequency and the counters are enabled. If switches 26 and 36 are in the X1 positions, after counter 22 progresses through one counting cycle a control signal from output CO of counter 22 will be fed back to the monitor and control logic 14 through switch 26. This will cause the output of gate G1 to go high, disabling the oscillator and the counters and terminating the timing operation. On the other hand, if switches 26 and 36 are in the X10 positions, counter 22 will progress through 10 counting cycles before a control signal is produced by counter 28, as previously described, to terminate the timing operation, thereby multiplying the primary timing interval set by oscillator 20 and counter 22 by a factor of 10.

As previously described, the absolute value of the output voltage of amplifier A1 will increase in a staircase fashion in the negative voltage direction in proportion to the count of the counter to which the amplifier is connected by switch 36, and the display device will display the percentage of the time interval being measured which has elapsed from the initiation of the timing operation.

As previously mentioned, display device 16 preferably displays both positive and negative voltage values. If the process variable which is normally monitored by the display device has a positive value, then the display of a negative voltage informs the operator that the display device is displaying time information. Also, if the display is a digital voltmeter which is normally capable of measuring and displaying ±10 volts, it is a relatively simple matter to derive a control signal from the output of gate G1 to move the decimal point on the digital display 86 so that an input voltage of −10.0 volts will be displayed as "−100." so that the display indicates percentage directly. If desired, the display device may also include an indicator, such as an LED display element, a light bulb, or an alphanumeric display to indicate when the display device is displaying time information.

As will be appreciated from the foregoing, the indicating electronic timers of the invention may be made self-contained, and, if desired, can be battery operated. Moreover, they can be easily incorporated into a control unit which houses the monitor and control logic, which is particularly convenient since the timer may be wired on the same printed circuit card as the monitor and control logic and may also "piggyback" on various of the electronic components used for monitor and control purposes. For example, the use of the same display device used for monitoring the process variable to display time information is a distinct advantage, as is the fact that real time is not displayed but rather a percentage of time, since this significantly reduces the number of components required. Also, since many integrated circuit packages contain a plurality of devices of the same type within a single package, e.g., quad amps, gates, etc., it may be possible to implement certain functions of the timer with unused devices in the integrated circuits which constitute the monitor and control logic. It is also an advantage that the time intervals measured by the electronic timer can be easily varied as desired, thereby enabling the timer to be readily employed for timing different events.

From the foregoing, it will also be appreciated that the indicating electronic timer may be implemented in a number of different ways. For example, an integrated circuit microprocessor may be employed in place of the oscillator, the counters, and the A/D converters. The microprocessor may incorporate software for performing the timing function and for directly driving the display device. Depending upon the available memory, the microprocessor could easily display real time instead of simply a percentage of time.

While a preferred embodiment of the invention has been shown and described, it will be apparent to those skilled in the art that changes can be made in this embodiment without departing from the principles and spirit of the invention, the scope of which is defined in the appended claims.

I claim:

1. In a system for controlling a process, timing apparatus comprising a display device normally operative to display a value representative of a process variable; control means responsive to the process variable attaining a predetermined value for producing a control signal to change the process from a first state to a second state; timing means responsive to the process variable attaining said predetermined value for measuring, during a predetermined period of time, the elapsed time from the time at which the process variable attains said predetermined value and for producing a timing signal having an instantaneous value representative of the elapsed time; and means for displaying on the display device, during said predetermined period of time and in place of the value representative of the process variable, a value dependent upon the relationship between the value of the timing signal and the predetermined period of time.

2. The apparatus of claim 1, wherein the control means is responsive to the elapsed time reaching the end of said predetermined period of time for producing another control signal to change the process back to the first state.

3. The apparatus of claim 1, wherein said timing signal comprises a voltage having a voltage value that varies between first and second limit values in accordance with the elapsed time, and wherein said displaying means comprises means for displaying the voltage value as a percentage of said predetermined period of time, said percentage comprising said value dependent upon the relationship between the value of the timing signal and the predetermined period of time.

4. The apparatus of claim 3, wherein the display device comprises a voltmeter, and the displaying means comprises means for adjusting said voltage value so that the voltmeter displays the numerical value of said percentage.

5. The apparatus of claim 3, wherein the value of said voltage increases in proportion to the elapsed time, and the displaying means displays the percentage of the predetermined period of time which has elapsed.

6. The apparatus of claim 3, wherein the value of the voltage decreases in proportion to the elapsed time, and the displaying means displays the percentage of the predetermined period of time which has not elapsed.

7. The apparatus of claim 3, wherein the control means comprises means for producing an enabling signal for initiating operation of the timing means upon the process variable attaining said predetermined value, and means for producing a disabling signal for terminating the operation of the timing means at the end of said predetermined period of time.

8. The apparatus of claim 7, wherein the timing means produces an output signal at the end of said predetermined period of time, and the control means is responsive to said output signal for producing said disabling signal.

9. The apparatus of claim 8, wherein the displaying means comprises a switch responsive to said enabling and disabling signals for selectively connecting the process variable and said voltage to the display device.

10. The apparatus of claim 1, wherein the timing means comprises an oscillator for generating a predetermined frequency, counter means connencted to the oscillator for counting said frequency and for providing a count value, and means responsive to the count value for producing a voltage having a value that is proportional to the count value, said voltage comprising said timing signal, and wherein said displaying means comprises means for displaying the voltage value as a percentage of said predetermined period of time, said percentage comprising said value dependent upon the relationship between the value of the timing signal and the predetermined period of time.

11. The apparatus of claim 1 further comprising means for selecting the length of said predetermined period of time.

12. Timing apparatus comprising an oscillator for generating a predetermined frequency; control means responsive to the occurrence of a predetermined event for enabling the operation of the oscillator for a predetermined period of time; counter means connected to the oscillator for counting said frequency, the counter means having an instantaneous count value that is representative of the elapsed time from the occurrence of the predetermined event; means responsive to the count value for producing a voltage having a voltage value that is dependent upon the relationship between the elapsed time and the predetermined period of time; and means for displaying the voltage value as a percentage of said predetermined period of time.

13. The apparatus of claim 12, wherein the counter means comprises a binary counter having outputs for signals representative of the count, and said voltage producing means comprises a digital-to-analog converter.

14. The apparatus of claim 13, wherein the digital-to-analog converter comprises a plurality of resistors connected to said outputs and to an input of an operational amplifier.

15. The apparatus of claim 14, wherein the values of said resistors are scaled in proportion to the decimal values represented by said outputs.

16. The apparatus of claim 13, wherein the counter means further comprises another binary counter connected to an output of the first-mentioned binary counter, said other binary counter having outputs for signals representative of its count, and wherein the voltage producing means comprises another digital-to-analog converter connected to the outputs of said other binary counter.

17. The apparatus of claim 16, wherein said other digital-to-analog converter comprises another plurality of resistors connected to the outputs of said other binary counter, and wherein means is provided for selectively connecting the input of said operational amplifier to the first-mentioned plurality and to said other plurality of resistors.

18. The apparatus of claim 17, wherein said voltage producing means comprises means for varying the resistance value of at least one of the resistors of said other plurality in accordance with the count of said other binary counter.

19. The apparatus of claim 16, further comprising means for presetting said other binary counter to a predetermined non-zero count.

20. The apparatus of claim 19, wherein said other binary counter is a four-stage counter and is configured to operate as a decade counter.

21. The apparatus of claim 12, wherein the voltage produced by said voltage producing means is proportional to the percentage of said predetermined period of time which has elapsed from the occurrence of said event.

22. The apparatus of claim 12, wherein the voltage producing means includes means for producing a voltage having a numerical value equal to said percentage, and wherein the displaying means comprises a voltmeter for indicating said percentage.

23. The apparatus of claim 12, wherein said control means includes means responsive to the counter means attaining a predetermined count for terminating the operation of said oscillator.

24. The apparatus of claim 12, wherein the apparatus is associated with a process for timing processing events, the control means being part of a means for controlling the process and the displaying means normally being connected to said process controlling means for displaying a value representative of a process variable, the apparatus further comprising switch means responsive to said control means for disconnecting the displaying means from said process controlling means upon the occurrence of said predetermined event and for connecting said voltage producing means to the displaying means for said predetermined period of time.

* * * * *